US008734167B2

(12) United States Patent
Aimoto

(10) Patent No.: US 8,734,167 B2
(45) Date of Patent: May 27, 2014

(54) ELECTRICAL CONNECTOR ASSEMBLY

(75) Inventor: Daiki Aimoto, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 54 days.

(21) Appl. No.: 13/473,881

(22) Filed: May 17, 2012

(65) Prior Publication Data

US 2013/0102181 A1 Apr. 25, 2013

(30) Foreign Application Priority Data

Oct. 24, 2011 (JP) ..... 2011-232903

(51) Int. Cl.
*H01R 12/00* (2006.01)

(52) U.S. Cl.
USPC ..... 439/74

(58) Field of Classification Search
USPC ..... 439/74, 248, 63, 578, 65; 324/755.04, 324/754.05
See application file for complete search history.

(56) References Cited

U.S. PATENT DOCUMENTS

| | | | | |
|---|---|---|---|---|
| 4,495,380 | A * | 1/1985 | Ryan et al. | 174/138 D |
| 4,697,859 | A * | 10/1987 | Fisher, Jr. | 439/246 |
| 4,925,403 | A * | 5/1990 | Zorzy | 439/578 |
| 5,137,462 | A | 8/1992 | Casey et al. | |
| 6,497,579 | B1 * | 12/2002 | Garbini | 439/63 |
| 6,623,279 | B2 * | 9/2003 | Derian et al. | 439/74 |
| 6,695,622 | B2 * | 2/2004 | Korsunsky et al. | 439/65 |
| 6,773,285 | B2 * | 8/2004 | Bernat et al. | 439/246 |
| 6,844,749 | B2 * | 1/2005 | Sinclair | 324/755.05 |
| 6,908,325 | B2 * | 6/2005 | Bernat et al. | 439/246 |
| 7,112,078 | B2 * | 9/2006 | Czikora | 439/248 |
| 7,210,941 | B2 * | 5/2007 | Rosenberger | 439/63 |
| 7,233,503 | B2 * | 6/2007 | Chen | 361/804 |
| 7,298,153 | B2 * | 11/2007 | Farris et al. | 324/754.05 |
| 7,545,159 | B2 * | 6/2009 | Winter | 324/755.05 |
| 7,985,079 | B1 * | 7/2011 | Wilson et al. | 439/74 |
| 8,317,539 | B2 * | 11/2012 | Stein | 439/578 |
| 8,360,789 | B2 * | 1/2013 | Yin et al. | 439/66 |
| 8,460,009 | B1 * | 6/2013 | Topolewski et al. | 439/65 |
| 2004/0038586 | A1 * | 2/2004 | Hall et al. | 439/578 |

FOREIGN PATENT DOCUMENTS

| | | |
|---|---|---|
| JP | 63-012869 A | 1/1998 |
| JP | 2011-060732 | 3/2011 |

* cited by examiner

*Primary Examiner* — Alexander Gilman
(74) *Attorney, Agent, or Firm* — Kubotera & Associates, LLC

(57) ABSTRACT

An electric connector assembly includes an intermediate connector for connecting the first attaching connector to the second attaching connector. The intermediate connector includes a power source terminal. The first attaching connector includes a first receiving terminal for contacting with the power source terminal, and the second attaching connector includes a second receiving terminal for contacting with the power source terminal. One of the first receiving terminal and the power source terminal and one of the second receiving terminal and the power source terminal include a metal cylindrical member capable of elastically deforming in a radial direction. Therefore, the power source terminal can incline and move in the radial direction at an arbitrary angle along a circumferential direction around an axial line of the power source terminal. The elastic cylindrical member includes a circumference elastically contacting with the power source terminal, the first receiving terminal, and the second receiving terminal.

9 Claims, 8 Drawing Sheets

ELECTRICAL CONNECTOR ASSEMBLY

BACKGROUND OF THE INVENTION AND RELATED ART STATEMENT

The present invention relates to an electrical connector assembly. More specifically, the present invention relates to an electrical connector assembly including a power supply terminal.

Patent Reference 1 has disclosed a conventional electrical connector assembly. The conventional electrical connector assembly disclosed in Patent Reference 1 includes a mating connector attached to a circuit board and an intermediate connector for connecting the mating connector to another mating connector attached to another circuit board.

In the conventional electrical connector assembly, each of the mating connectors includes a fixed contact (a terminal) having a pin shape and extending in a connecting direction of the mating connectors. A plurality of the fixed contacts is planted in multiple places forming rows and columns on a plane perpendicular to the connecting direction. The intermediate connector includes a movable contact formed by bending a metal strip in a thickness direction thereof. The movable contact is capable of elastically displacing in the thickness direction.

In the conventional electrical connector assembly, the movable contact includes a pair of elastic pieces provided so as to face each other in the thickness direction in order to sandwich and hold the fixed contact. A connecting portion connects the elastic pieces in the pair as one component, so that the elastic pieces of the pair have a certain amount of space with each other. The pair of the elastic pieces of the movable contact has a cantilever shape with the connecting portion as a base portion thereof. Further, the elastic piece includes contact portions on both of distal ends thereof for contacting both of the mating connectors. The contact portion is formed by partially narrowing the space of the pair of the elastic pieces. In addition, the pair of the elastic pieces further includes a pair of contact pieces facing each other. The pair of the contact pieces is displaced by bending elastically in order to receive and sandwich the fixed contact of the mating connector.

In the conventional electrical connector assembly described in Patent Reference 1, when the mating connectors are connected to the intermediate connector, the two mating connectors are allowed to move relatively against the intermediate connector in directions different from each other, within a plane perpendicular to the connecting direction in a permissible range, respectively.

Particularly further, one of the directions, in which the mating connectors move relatively, is the thickness direction of the elastic piece of the movable contact of the intermediate connector. More specifically, when the fixed contact presses the movable contact, the movable contact is elastically displaced in the thickness direction, so that the mating connector is allowed to move in the thickness direction of the elastic piece. As the other one of the directions, the mating connectors move relatively in a direction of a plate surface of the metal strip. More specifically, when the fixed contact is moved slidingly along the plate surface of the elastic piece of the movable connector, the mating connector is allowed to move in the direction of the plate surface of the elastic piece.

As described above, in the conventional electrical connector assembly described in Patent Reference 1, the mating connectors are capable of compensating a shift in positions of each other in the two directions within the plane perpendicular to the connecting direction. In other words, the mating connectors are capable of floating in the two directions.

Patent Reference 1: Japanese Patent Publication No. 2011-060732

In the conventional electrical connector assembly disclosed in Patent Reference 1, the movable contact of the intermediate connector is formed by bending the metal strip in the thickness direction. Further, the intermediate connector includes the pair of the elastic pieces facing each other in the thickness direction. The elastic pieces in the pair are connected to each other through the connecting portion. With a configuration described above, the conventional electrical connector assembly includes some problems as described below.

First, in the conventional electrical connector assembly, the contact portion is bent only in the thickness direction. As a result, the floating in the two directions described above is composed of the elastic displacement in the thickness direction and a sliding movement being accompanied with a friction force in the direction of the plate surface. Consequently, when the mating connector moves in the two directions, two forces in different types, in other words, the elastic force in one direction and the friction force in another direction, are applied between the fixed contact and the movable contact.

As a result, in the conventional electrical connector assembly, an amount of the shift and the contact pressure are varied according to the direction of the shift. Accordingly, when the mating connectors move in the direction along the same straight line, capability of compensating the shift in positions thereof is varied according to the direction of the shift. For example, the contact pressure is proportional to the amount of the displacement in the direction of the elastic displacement. Therefore, the contact pressure may be increased or decreased according to the amount of the displacement. On the other hand, regardless the amount of the sliding movement, the contact pressure in the direction of the sliding movement is equal to an initial elasticity the contact portion receives in the first place.

Second, in the conventional electrical connector assembly, the elastic piece is bent only in the thickness direction. Therefore, a contact region of the elastic piece contacting to the fixed contact has a shape of a straight line. That is, a length of one side of a rectangular sectional shape of the fixed contact corresponds to the longest contact region. Accordingly, the length of the contact region tends to be insufficient. When the fixed contact has the circular sectional shape, the contact region has the shape of a dot.

Third, in the conventional electrical connector assembly, as described above, the elastic pieces on an upper side and a lower side are formed as the one component. Therefore, because of the difference between the floatings in the two directions described above, when the mating connectors move in the different directions from each other, not along the same straight line, the electrical connector assembly has a different capability for compensating the shift for each of the mating connectors.

Fourth, in the conventional electrical connector assembly, the elastic pieces on the upper side and on the lower side are formed as the one component. Therefore, the elastic piece has relatively high rigidity since the elastic pieces on the upper side and on the lower side restrain each other. As a result, when the elastic piece shifts in the direction of the elastic displacement, the amount of the elastic displacement thereof is relatively low while the contact pressure thereof is relatively high. In addition, it is difficult that the elastic pieces on the upper side and on the lower side are displaced elastically as being independent of each other.

In view of the problems described above, an object of the present invention is to provide an electrical connector assembly which solves the problems of the conventional electrical connector assembly. In the electrical connector assembly of the present invention, mating connectors include a receptacle terminal being independent of each other mating connector. Further, the receptacle terminal contacts a power supply terminal of an intermediate connector with both ends thereof. Accordingly, the mating connector is capable of floating in two directions at any angle in a circumferential direction thereof.

SUMMARY OF THE INVENTION

In order to attain the objects described above, according to a first aspect of the present invention, an electrical connector assembly includes a first mating connector attached to a first circuit member, a second mating connector attached to a second circuit member and an intermediate connector being arranged between the first mating connector and the second mating connector for connecting the first mating connector and the second mating connector. The intermediate connector includes a power supply terminal having a straight shape. Further, the first mating connector and the second mating connector include a first receptacle terminal and a second receptacle terminal, respectively. The first receptacle terminal and the second receptacle terminal receive a corresponding end portion of the power supply terminal and contact a circumferential surface of the corresponding end portion, respectively.

According to the first aspect of the present invention, in the electrical connector assembly, either the first receptacle terminal or the power supply terminal includes, further, either the second receptacle terminal or the power supply terminal includes an elastic tubular member made of metal and capable of elastic displacement in a direction of a radius thereof. Accordingly, the power supply terminal is able to tilt toward any angle in a circumferential direction around an axis thereof or able to move in the direction of the radius. Further, when the elastic tubular member is elastically displaced, the power supply terminal contacts the first receptacle terminal or the second receptacle terminal through a circumferential surface of the elastic tubular member.

According to the first aspect of the present invention, in the electrical connector assembly, the power supply terminal of the intermediate connector contacts the first receptacle terminal of the first mating connector and the second receptacle terminal of the through the circumferential surface of the elastic tubular member. The elastic tubular member is independently provided so as to correspond to the both ends of the power supply terminal which has the straight shape and rigidity. As described above, the elastic tubular member situated between one end of the power supply terminal of the intermediate connector and the receptacle terminal of the first mating connector is provided independently of the elastic tubular member situated between another end of the power supply terminal of the intermediate connector and the receptacle terminal of the second mating connector, and vice versa. Accordingly, the first mating connector and the second mating connector are capable of floating without influence from each other. Further, the elastic tubular member has a tubular shape having a constant elasticity in the direction of the radius at any angle in the circumferential direction thereof. Therefore, the elastic tubular member is displaced equally regardless of the angle in the circumferential direction. As a result, the floating is caused by a single mechanism.

According to a second aspect of the present invention, the elastic tubular member is formed by rolling a metal plate into a tubular shape. The elastic tubular member may include a slit in multiple positions in the circumferential direction thereof. The slit may be formed between the both end portions so as to extend in the direction of an axis of the elastic tubular member. Further, an annular narrow portion may be formed in a middle portion in the direction of the axis of the elastic tubular member. The annular narrow portion has a radius narrower than the radius of both end portions in the direction of the axis of the elastic tubular member, enabling the elastic tubular member to be retained in the first receptacle terminal and the second receptacle terminal.

According to the second aspect of the present invention, side edge portions of the elastic tubular member in the circumferential direction formed upon being rolled into the tubular shape may be arranged to have a space so as to be apart from each other, allowed to abut against each other. Or the side edge portions may be connected to each other by welding and the like. Moreover, the side edge portions may be arranged so as to have a gap therebetween or so as to overlap with each other. The elastic tubular member is most displaced elastically at the annular narrow portion thereof.

According to a third aspect of the present invention, the first receptacle terminal and the second receptacle terminal may include receptacle holes for receiving the elastic tubular member, respectively. It is preferable that the receptacle hole includes a controlling portion in an inner circumferential portion thereof. The controlling portion prevents the radius of the annular narrow portion of the elastic tubular member from being enlarged excessively. With the controlling portion, it is possible to prevent the elastic tubular member retained in the receptacle hole from being elastically displaced excessively.

According to a fourth aspect of the present invention, the elastic tubular member is formed by rolling the metal plate into the tubular shape. And the elastic tubular member may include the slit in multiple positions in the circumferential direction thereof. Further, the slit may be formed between the both end portions so as to extend in the direction of the axis of the elastic tubular member. Furthermore, the elastic tubular member may include an annular expanding portion in the middle portion in the direction of the axis thereof. The annular expanding portion has a radius larger than the radius of both end portions in the direction of the axis of the elastic tubular member. Accordingly, the elastic tubular member is allowed to be fitted to outer circumferential surfaces of the both end portions of the power supply terminal. In this case, it is preferable that the power supply terminal includes a fitting outer circumferential surface to which the elastic tubular member is fitted. In addition, it is preferable that the fitting outer circumferential surface includes a regulating portion for preventing a radius of an inner circumferential surface of the annular expanding portion of the elastic tubular member from shrinking.

According to a fifth aspect of the present invention, the regulating portion may abut against the annular expanding portion in order to prevent the elastic tubular member from being elastically displaced excessively.

As described above, according to the present invention, the receptacle terminals of the mating connectors to be connected respectively to the both end portions of the power supply terminal are provided so as to be independent of each other. Further, either the receptacle terminal or the end portion of the power supply terminal includes the elastic tubular member. Accordingly, it is possible to obtain the floating by the same amount at any angle in the circumferential direction. As a result, it is possible to contact at any angle between the mating connector and the intermediate connector, as well as enabling the floating sufficiently and obtaining the contact pressure sufficiently.

BRIEF DESCRIPTION OF THE DRAWINGS

FIGS. 1(A) and 1(B) are perspective view showing an electrical connector assembly according to a first embodiment of the present invention, wherein FIG. 1(A) shows an intermediate connector, a first mating connector and a second mating connector of the electrical connector assembly in a state before being connected to each other, and FIG. 1(B) shows the intermediate connector, the first mating connector and the second mating connector of the electrical connector assembly in a state after being connected to each other;

FIGS. 5(A) and 5(B) are longitudinal sectional views showing the electrical connector assembly in a state that the intermediate connector, the first mating connector and the second mating connector are connected to each other according to the first embodiment of the present invention, wherein FIG. 5(A) is a longitudinal sectional view of the electrical connector assembly taken along the direction perpendicular to the direction in which the power supply terminal are arranged, and FIG. 5(B) is a longitudinal sectional view of the electrical connector assembly taken along the direction in which the power supply terminals are arranged;

DETAILED DESCRIPTION OF THE PREFERRED EMBODIMENTS

Hereunder, embodiments of the present invention will be explained with reference to the accompanying drawings.

First Embodiment

Figure 1B:
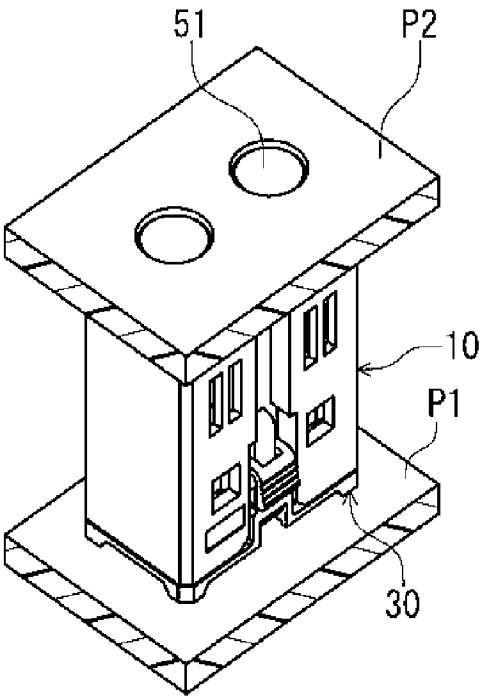
Figure 1A:
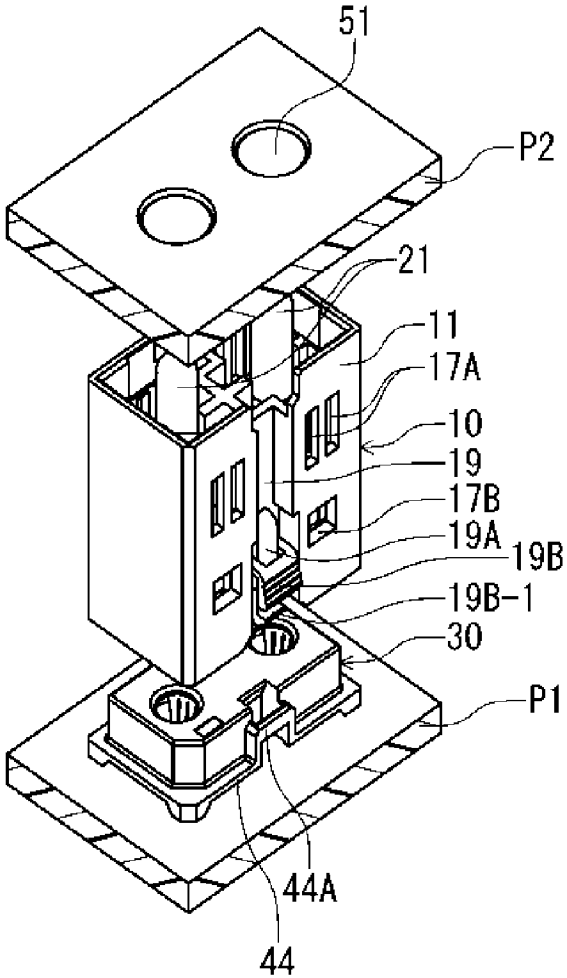

A first embodiment of the present invention will be explained. FIGS. 1(A) and 1(B) are perspective views showing an electrical connector assembly according to the first embodiment of the present invention. FIG. 1(A) shows an intermediate connector 10, a first mating connector 30 and a second mating connector 50 of the electrical connector assembly in a state of before being connected to each other. FIG. 1(B) shows the intermediate connector 10, the first mating connector 30 and the second mating connector 50 of the electrical connector assembly in a state of after being connected to each other.

Figure 2:
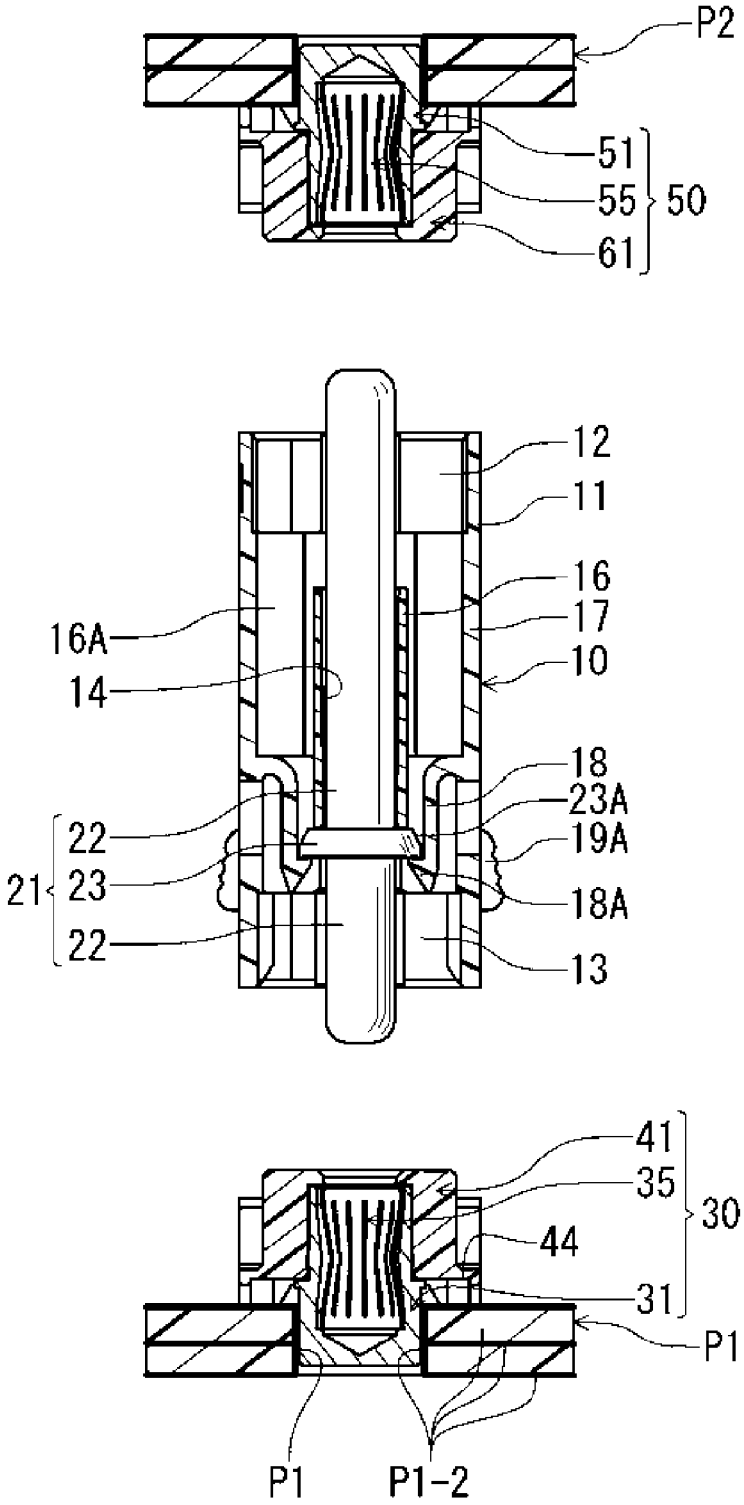
FIG. 2 is a longitudinal sectional view showing the electrical connector assembly taken along a direction perpendicular to a direction in which power supply terminals are arranged according to the first embodiment of the present invention.
Figure 3:
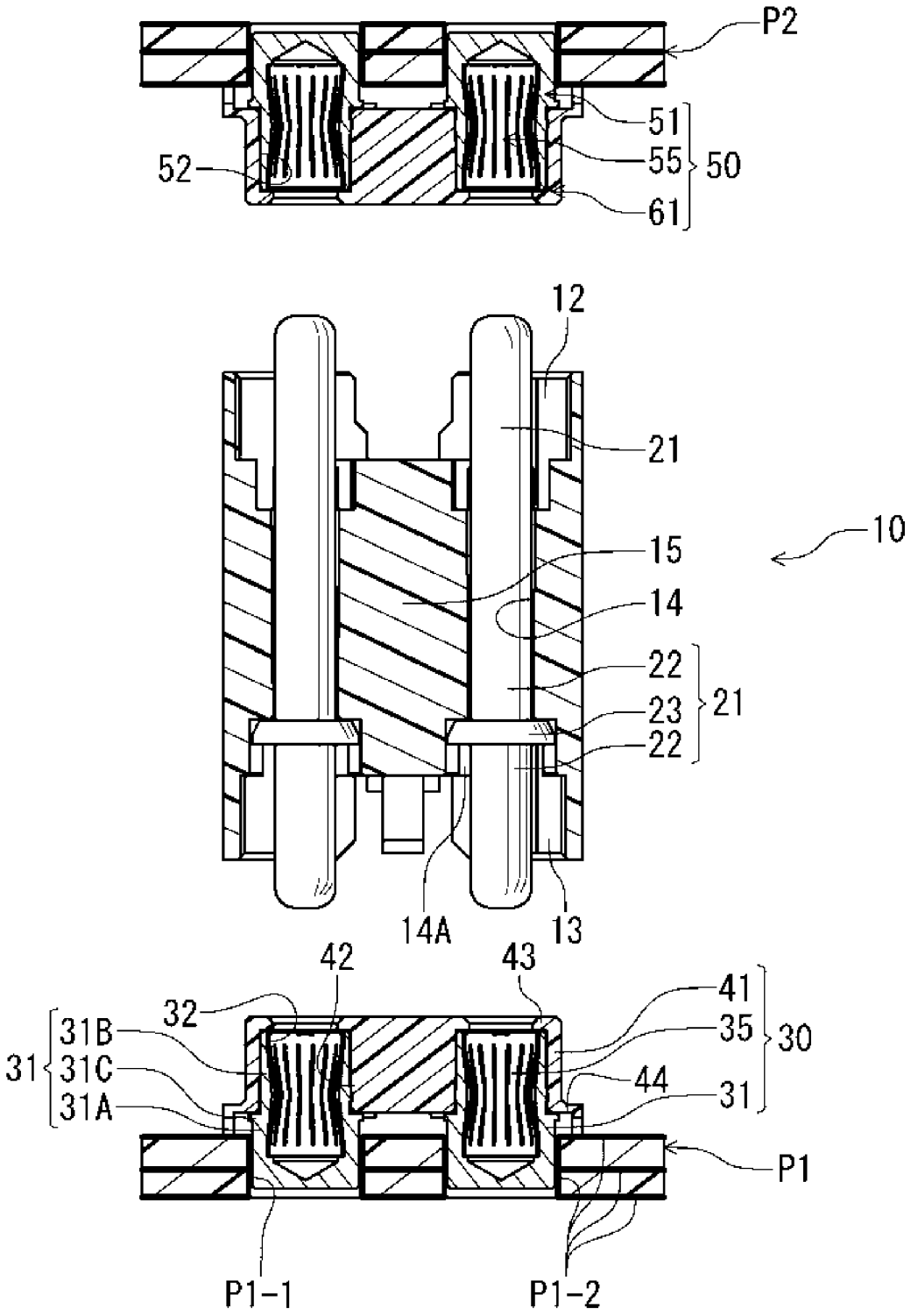
FIG. 3 is a longitudinal sectional view showing the electrical connector assembly taken along the direction in which the power supply terminals are arranged according to the first embodiment of the present invention.
Figure 5B:
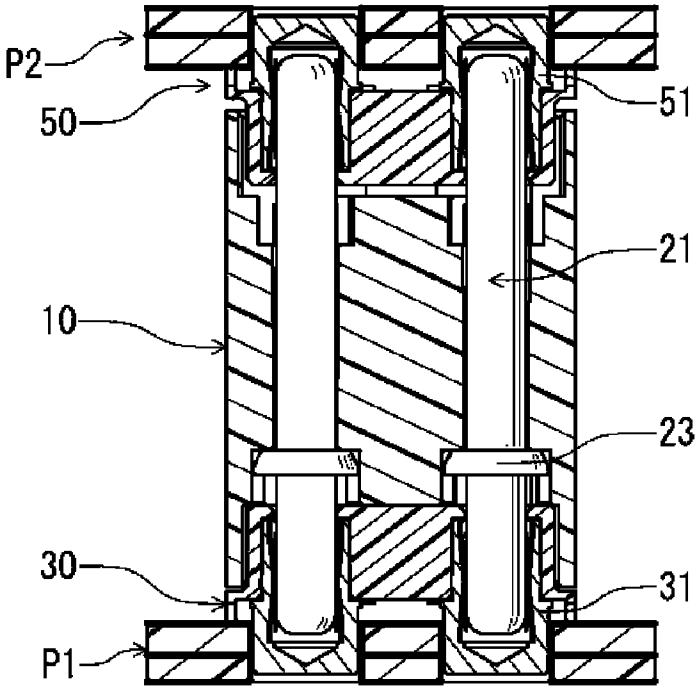
Figure 5A:
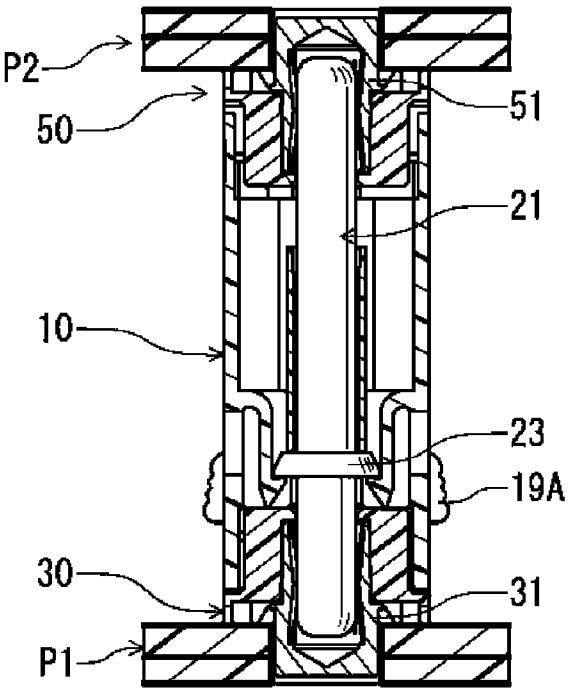

FIG. 2 is a longitudinal sectional view showing the electrical connector assembly taken along a direction perpendicular to a direction in which power supply terminals are arranged, according to the first embodiment of the present invention. FIG. 3 is a longitudinal sectional view showing the electrical connector assembly taken along the direction the power supply terminals are arranged, according to the first embodiment of the present invention. FIGS. 5(A) and 5(B) are longitudinal sectional views showing the electrical connector assembly in a state that the intermediate connector 10, the first mating connector 30 and the second mating connector 50 are connected to each other according to the first embodiment of the present invention. FIG. 5(A) is a longitudinal sectional view of the electrical connector assembly taken along the direction perpendicular to the direction the power supply terminals are arranged, and FIG. 5(B) is a longitudinal sectional view of the electrical connector assembly taken along the direction the power supply terminals are arranged.

FIGS. 1(A), 2 and 3 show the electrical connector assembly in a state of before the intermediate connector 10 thereof is connected to mating connectors, that is, the first mating connector 30 and the second mating connector 50 thereof. FIGS. 1(B), 5(A) and 5(B) show the electrical connector assembly in the state that the intermediate connector 10 thereof is connected to the mating connectors, that is, the first mating connector 30 and the second mating connector 50 thereof.

As shown in FIGS. 1(A) and 1(B), the intermediate connector 10 includes a housing 11 and two power supply terminals 21. The housing 11 is made of an electrical insulating material and has a substantial rectangular tubular shape with a space penetrating in a vertical direction. The power supply terminal 21 is supported by the housing 11 and extending in the vertical direction within the space of the housing 11 penetrating vertically. The power supply terminal 21 is made from a metal and has a shape of a straight pin. In the embodiment, the intermediate connector 10 includes two power supply terminals, but number of the power supply terminals is not limited two. The number of the power supply terminals may be one or three and more. Further, the power supply terminals may be arranged in a single row or in multiple rows.

In the first embodiment of the present invention, the power supply terminal 21 is made as a rigid body and includes a main body portion 22 and a flange portion 23. The main body portion 22 has a shape of a pin with a circular sectional shape. The flange portion 23 is provided in a lower portion of the power supply terminal 21. The flange portion 23 has a shape of a ring projecting outward in a direction of a radius of the main body portion 22. An upper end and a lower end of the main body portion 22 are formed to be rounded, so that the first mating connector 30 and the second mating connector 50 as the mating connectors are able to be connected thereto ideally, as described later. Further, the flange portion 23 includes a circumferential surface 23A having a conic shape expanding in a lower direction.

In the first embodiment of the present invention, the power supply terminal 21 is longer than a size of the housing in the vertical direction. Therefore, upon being supported by the housing 11, the power supply terminal 21 protrudes from an upper end and a lower end of the housing 11. In the embodiment, the power supply terminal 21 protrudes from the upper end and the lower end of the housing 11. The power supply terminal 21 may be depressed from the housing 11. In this case, terminals of the mating connectors, that is, terminals of the first mating connector 30 and the second mating connector 50 enter the housing 11.

In the first embodiment of the present invention, the housing 11 for supporting the power supply terminal 21 having the rectangular tubular shape has a rectangular sectional shape which is elongated in a direction the power supply terminals 21 are arranged. The housing 11 includes receptacle portions 12 and 13 in an upper and lower edge portions thereof, respectively. The receptacle portions 12 and 13 receive the first mating connector 30 and the second mating connector 50 having rectangular tubular shapes as described later, respectively. A terminal penetrating portion 14 is formed between the receptacle portions 12 and 13 in the vertical direction.

As shown in FIG. 3, the terminal penetrating portion 14 has a hole formed on a central wall portion 15 as being viewed in the direction the power supply terminals 21 are arranged. A space is formed between an inner surface of the terminal penetrating portion 14 and the power supply terminal 21.

Further, as shown in FIG. 2, the terminal penetrating portion 14 has a hole formed between thin walls 16 as being viewed in the direction perpendicular to a direction the power supply terminals 21 are arranged. A space is formed between an inner surface of the thin wall 16 and the power supply terminal 21. In addition, the thin wall 16 forms a space 16A between a rear side thereof and a sidewall 17.

In the first embodiment, the terminal penetrating portion 14 includes a concaved portion 14A as shown in FIG. 3 in a lower portion thereof. As shown in FIG. 3, an upper surface of the flange portion 23 is to abut against a bottom portion of the concaved portion 14A situated in a lower side.

As shown in FIG. 2, the terminal penetrating portion 14 further includes an elastic arm portion 18 in the lower portion thereof. The elastic arm portion 18 extends from a middle portion of the sidewall 17 of the housing 11, at a position situated on an upper side relative to the flange portion 23. The elastic arm portion 18 extends in the lower direction. The elastic arm portion 18 engages a lower surface of the flange portion 23 with a hook portion 18A provided in a lower end thereof.

Accordingly, the upper surface of the flange portion 23 is held by the bottom portion of the concaved portion 14A and an edge portion of the thin wall 16 in one of the direction of the radius, as well as the lower surface of the flange portion 23 is held by the hook portion 18A of the elastic arm portion 18 in a direction perpendicular to the direction supra. Thereby, the power supply terminal 21 is positioned vertically.

In the first embodiment, when the power supply terminal 21 is inserted into the terminal penetrating portion 14 from the lower direction, the circumferential surface 23A having the conic shape of the flange portion 23 thereof abuts against the hook portion 18A. Then the power supply terminal 21 is inserted further as the elastic arm portion 18 is pushed outward to be displaced elastically. When the upper surface of the flange portion 23 abuts against the bottom portion of the concaved portion 14A, the elastic arm portion 18 stops being displaced or recovers from the elastic displacement thereof as the hook portion 18A leaves the flange portion 23. Therefore, the hook portion 18A engages the lower surface of the flange portion 23. Thereby, the flange portion 23 is held as the upper and lower surfaces thereof are sandwiched.

The housing 11 includes a window portion 17A (refer to FIGS. 1(A) and 1(B)). The window portion 17A is provided on the sidewall 17 and communicates with the space 16A formed between the thin wall 16 and the sidewall 17 shown in FIG. 2. The housing 11 further includes a window portion 17B on the sidewall 17. The window portion 17B is provided on a side position relative to the elastic arm portion 18. The window portions 17A and 17B ventilate the housing 11 to radiate heat generated by the power supply terminal 21.

In the first embodiment, as shown in FIGS. 1(A) and 1(B), the housing 11 further includes a groove portion 19 in an outer surface of the sidewall 17 thereof having the window portions 17A and 17B. The groove portion 19 extends in the vertical direction. A locking arm 19A extending in the lower direction and capable of elastic displacement is provided in a lower portion of the groove portion 19. Further, a button portion 19B is provided in a lower edge of the locking arm 19A. Therefore, by being operated externally, a hook portion 19B-1 provided in the button portion 19B is allowed to lock and unlock a lower surface of a corresponding engaging portion 44A of the first mating connector 30 from inside.

In the first embodiment, the first mating connector 30 and the second mating connector 50 as the mating connectors are assigned different numbers for being situated in different positions in the vertical direction. The first mating connector 30 and the second mating connector 50 have the same configuration. Therefore, hereunder, the first mating connector 30 situated in a lower position will be explained. As for the second mating connector 50 situated in an upper position, components thereof will be numbered adding twenty to numbers of corresponding components of the first mating connector 30 and explanation thereof will be omitted.

In the first embodiment, the first mating connector 30 and the second mating connector 50 are attached to a first circuit board P1 and a second circuit board P2 as circuit members, respectively. The first circuit board P1 and the second circuit board P2 have similar configurations.

As shown in FIGS. 2 and 3, the first mating connector 30 includes a first receptacle terminal 31, a housing 41 for holding the first receptacle terminal 31 and an elastic tubular member 35. The first receptacle connector 31 is made of metal and has a cylindrical shape with a bottom surface. The housing 41 is made of an electrical insulating material. The elastic tubular member 35 is made of metal and retained in the first receptacle terminal 31.

Figure 4B:
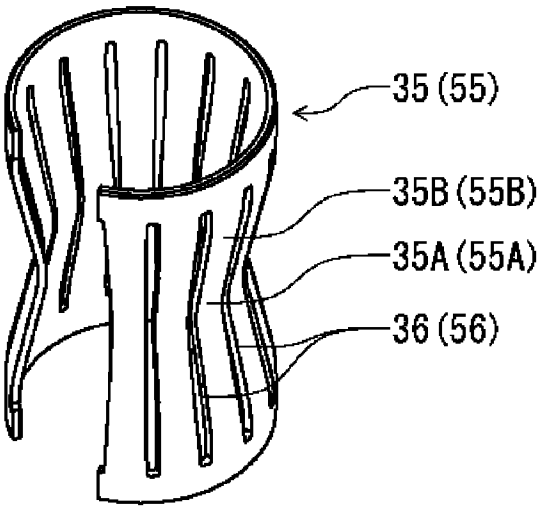
FIG. 4(B) is a perspective view showing an elastic tubular member to be retained in the first receptacle terminal of the electrical connector assembly according to the first embodiment of the present invention.
Figure 4A:
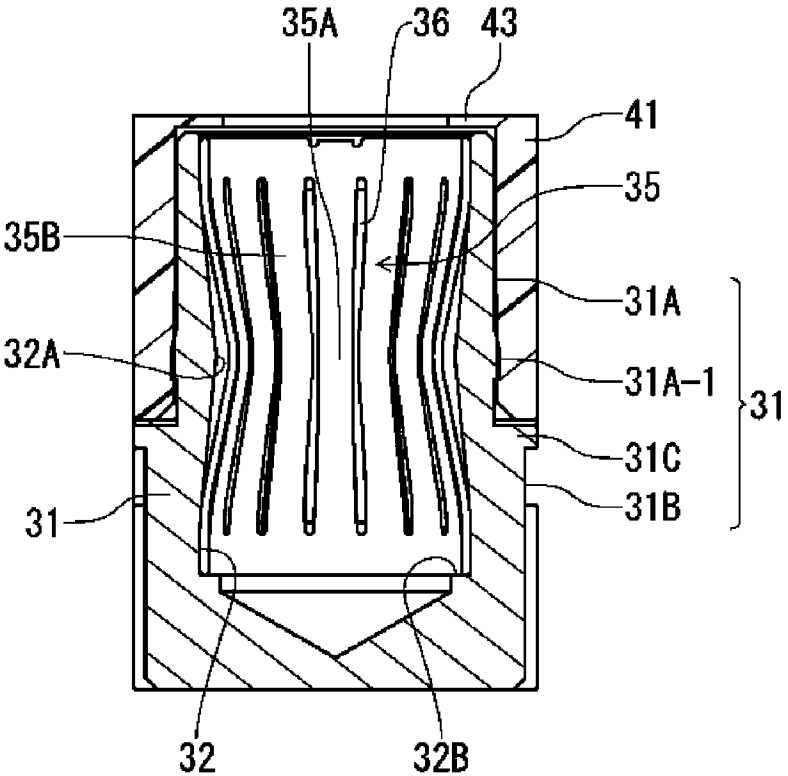
FIG. 4(A) is an enlarged sectional view showing a first receptacle terminal of the electrical connector assembly according to the first embodiment of the present invention.

FIG. 4(A) is an enlarged sectional view showing the first receptacle terminal 31 of the electrical connector assembly, according to the first embodiment of the present invention. When the first mating connector 30 in FIG. 4(A) is flipped over in the vertical direction, the second mating connector 50 in FIGS. 1 to 3 is shown in a similar way in the vertical direction with the first mating connector 30 in FIG. 4(A).

In the first embodiment, a receptacle hole 32 is formed in the first receptacle terminal 31 as shown in FIG. 4(A). An inner surface of the receptacle hole 32 has a cylindrical shape opening in an upper direction. The first receptacle terminal 31 has a cylindrical outer circumferential surface in both of an opening side and a bottom side. That is, an opening side cylindrical outer circumferential surface 31A and a bottom side cylindrical outer circumferential surface 31B. The opening side cylindrical outer circumferential surface 31A has an outer radius smaller than the bottom side cylindrical outer circumferential surface 31B. The first receptacle terminal 31 includes an annular protrusion 31C on a boundary region between the opening side cylindrical outer circumferential surface 31A and the bottom side cylindrical outer circumferential surface 31B. The annular protrusion 31C has a larger radius than either the opening side cylindrical outer circumferential surface 31A or the bottom side cylindrical outer circumferential surface 31B.

In the first embodiment, the opening side cylindrical outer circumferential surface 31A includes an engaging protrusion 31A-1. Further, an annular abutting portion 32B having a step-like shape is formed in a bottom side of the inner surface of the receptacle hole 32. The inner surface of the receptacle hole 32 is tapered so as to slightly decrease an inner radius thereof toward a middle portion in a direction of an axis of the cylinder. The inner surface of the receptacle hole 32 has a controlling portion 32A in the middle portion thereof. The radius of the inner surface of the receptacle hole 32 becomes the smallest where the controlling portion 32A is situated. The controlling portion 32A and neighborhood thereof prevent a radius of the elastic tubular member 35 from being excessively enlarged elastically.

FIG. 4(B) is a perspective view showing the elastic tubular member 35 of the electrical connector assembly according to the first embodiment of the present invention. The elastic tubular member 35 is retained in the first receptacle terminal 31. As shown in FIG. 4(B), the elastic tubular member 35 to be retained in the receptacle hole 32 of the first receptacle terminal 31 is made by rolling a metal plate into a tubular shape after forming a slit 36 on the metal plate. The slits 36 extend in the direction of the axis being situated in multiple positions in a circumferential direction of the elastic tubular member 35. Further, the slit 36 is formed between both end portions in the direction of the axis of the elastic tubular member 35. Accordingly, the elastic tubular member 35 has a ring shape at the both end portions in the direction of the axis thereof, since the slit 36 is not provided in the both end portions thereof.

In the first embodiment, the elastic tubular member 35 is formed so as to shrink a radius thereof in a middle portion in the direction of the axis. Therefore, the elastic tubular member 35 includes an annular narrow portion 35A in the middle portion thereof. When the elastic tubular member 35 is rolled into the tubular shape with the annular narrow portion 35A after forming the slit 36 on the metal plate, abutting portions thereof to be faced each other in the circumferential direction may be connected or may be left so as to be apart from each other. The elastic tubular member 35 is retained in the receptacle hole 32 as the radius thereof is elastically crimped temporarily. After being retained in the receptacle hole 32 of the first receptacle terminal 31, the elastic tubular member 35 is positioned as the radius thereof is recovered then elastically abuts against the inner surface of the receptacle hole 32. Further, the elastic tubular member 35 is positioned in the direction of the axis as a circumferential edge of one end portion thereof abuts against the annular abutting portion 32B situated in the bottom side of the receptacle hole 32.

As shown in FIG. 3, the housing 41 for supporting the first receptacle terminal 31 includes two supporting holes 42 for holding the first receptacle terminals 31, respectively. A region of the bottom side cylindrical outer circumferential surface 31B of the first receptacle terminal 31 is retained to be held in the supporting hole 42.

As shown in FIGS. 2 and 3, the housing 41 includes an inner annular protruding portion 43 protruding inwardly in a direction of the radius. The inner annular protruding portion 43 is provided on a circumferential edge of the opening side of the supporting hole 42. Further, the housing 41 includes an outer annular protruding portion 44 provided in the bottom side of the supporting hole 42. The outer annular protruding portion 44 protrudes outwardly in the direction of the radius from an outer circumferential surface of the housing 41. An inner circumferential edge of the inner annular protruding portion 43 has an inner radius capable of receiving the power supply terminal 21.

In the first embodiment, the outer annular protruding portion 44 includes the corresponding engaging portion 44A at a position corresponding to the button portion 19B in the circumferential direction (refer to FIG. 1(A)). The corresponding engaging portion 44A is formed by raising the outer annular protruding portion 44 into a shape of a gate. The button portion 19B is provided in the housing 11 of the intermediate connector 10 and capable of elastic deformation. The hook portion 19B-1 of the button portion 19B engages the lower surface of the corresponding engaging portion 44A from an inner direction. The opening side cylindrical outer circumferential surface 31A of the first receptacle terminal 31 is forcibly inserted into the supporting hole 42 of the housing 41. Then the engaging protrusion 31A-1 formed on the opening side cylindrical outer circumferential surface 31A bites into an inner surface of the supporting hole 42. Thereby, it is possible to prevent the first receptacle terminal 31 from coming off. Accordingly, the bottom side cylindrical outer circumferential surface 31B of the first receptacle terminal 31 held by the housing 41 protrudes from the supporting hole 42 of the housing 41. Further, the bottom side cylindrical outer circumferential surface 31B protrudes from an attachment surface of the housing 41 for attaching to the first circuit board P1 as well. Thereby, the first mating connector 30 is configured completely.

In the first embodiment, the first mating connector 30 is attached to the first circuit board P1. The first circuit board P1 includes a through hole P1-1 thereon. The bottom side cylindrical outer circumferential surface 31B of the first receptacle terminal 31 enters into the through hole P1-1 without penetrating. An inner surface of the through hole P1-1 conducts electrically with a circuit layer P1-2 formed on both surfaces and inside of the first circuit board P1. Therefore, the first receptacle terminal 31 conducts to the circuit layer P1-2 electrically by soldering a space formed between the bottom side cylindrical outer circumferential surface 31B thereof and an inner circumferential surface of the through hole P1-1. Thereby, the first mating connector 30 is attached to the first circuit board P1.

In the first embodiment, the second mating connector 50 has the same configuration with the first mating connector 30 and is attached and connected to the second circuit board P2 in a similar way.

In the first embodiment, the first mating connector 30, the second mating connector 50 and the intermediate connector 10 thus configured are utilized as follows.

As shown in FIGS. 2 and 3, the first mating connector 30 attached to the first circuit board P1 is placed so as to face upward. Next, the intermediate connector 10 placed above the first mating connector 30 so that the button portion 19B of the locking arm 19A thereof is situated in a lower side. Then the intermediate connector 10 thus placed is moved in the lower direction.

Next, the power supply terminal 21 of the intermediate connector 10 is inserted into the tubular cylindrical member 35 in the first receptacle terminal 31 of the first mating connector from the lower end thereof. When the power supply terminal 21 is inserted further, a lower end of the power supply terminal 21 reaches a predetermined position, elastically enlarging the radius of the annular narrow portion 35A of the tubular cylindrical member 35. The tubular cylindrical member 35 thus enlarged the radius thereof elastically abuts against an outer circumferential surface of the lower end of the power supply terminal 21 as well as increasing an elastic contact pressure thereof against the inner surface of the receptacle hole 32 of the first receptacle terminal 31.

When the lower end of the power supply terminal 21 is inserted to the predetermined position, the hook portion 19B-1 of the button portion 19B of the locking arm 19A of the intermediate connector 10 engages the lower surface of the corresponding engaging portion 44A formed in the outer annular protruding portion 44 of the first mating connector 30 from the inner direction. Therefore, it is possible to prevent the intermediate connector 10 from coming off from the first mating connector 30. When the intermediate connector 10 is extracted, the intermediate connector 10 is lifted as unlocking the hook portion 19B-1 thereof by pushing the button portion 19B thereof.

Next, the second mating connector 50 attached to the second circuit board P2 is placed so as to face downward. Then the second mating connector 50 is moved downward to the intermediate connector 10 connected to the first mating connector 30. Accordingly, an upper end of the power supply terminal 21 of the intermediate connector 10 is inserted into the elastic tubular member 55 in the second receptacle terminal 51 of the second mating connector 50. As a result, the intermediate connector 10 is connected to the second mating connector 50 in a similar way to be connected the first mating connector 30.

The intermediate connector 10 does not include a button portion for engaging an outer annular protruding portion 64 of the second mating connector 50. Therefore, the second mating connector 50 is extracted from the intermediate connector 10 by only being lifted. As described above, the first mating connector 30 and the second mating connector 50 are connected to each other through the intermediate connector 10 (refer to FIGS. 5(A) and 5(B)).

As described above, in the first embodiment, when a force in a horizontal direction is applied to the first circuit board P1 and the second circuit board P2, the first mating connector 30 and second mating connector 50 connected to each other through the intermediate connector 10 move with the first circuit board P1 and the second circuit board P2, respectively.

Figure 6:
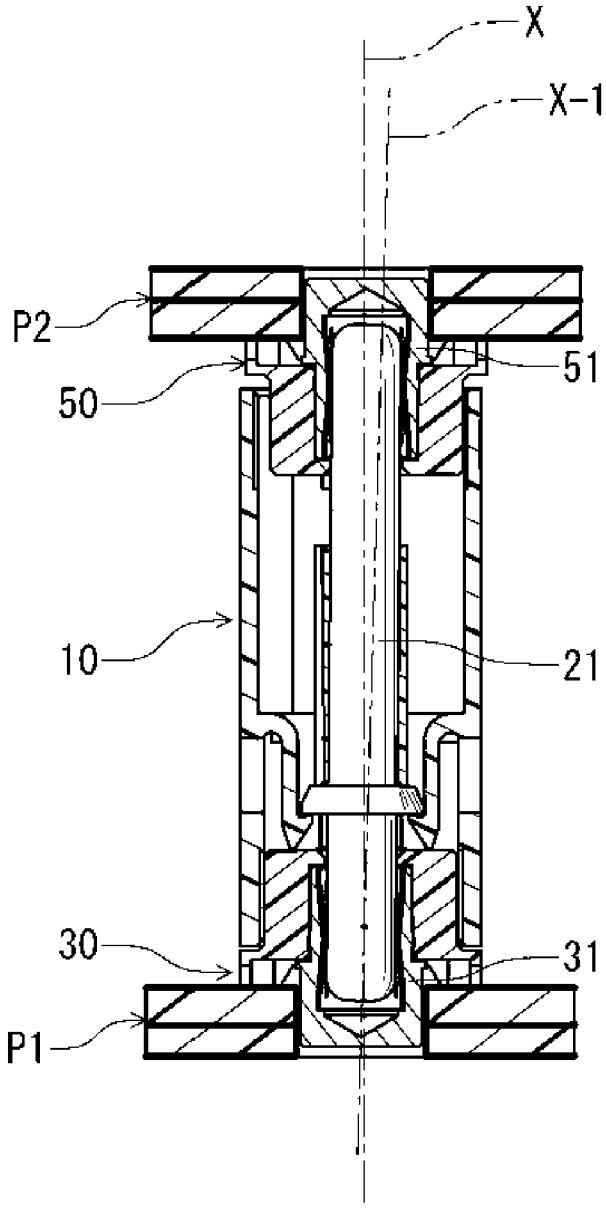
FIG. 6 is a longitudinal sectional view showing the electrical connector assembly in a state that the power supply terminals are tilted as the first mating connector and the second mating connector are shifted from each other according to the first embodiment of the present invention.

FIG. 6 is a longitudinal sectional view showing the electrical connector assembly according to the first embodiment of the present invention, in a state that the power supply terminal 21 is tilted since the first mating connector 30 and the second mating connector 50 are shifted from each other.

As shown in FIG. 6, the power supply terminal 21 situated in a regular position before being tilted has an axis line X. In the case mentioned above, the axis line X is tilted to the axis line X-1 as the power supply terminal 21 is tilted. The elastic tubular member 35 of the first mating connector 30 and the elastic tubular member 55 of the second mating connector 50 enable the axis line to tilt in such a way by elastic displacement in the direction of the radius thereof.

In the first embodiment, the elastic tubular members 35 and 55 are capable of the elastic displacement at any angle within a circumference direction of the power supply terminal 21. Further, the elastic tubular members 35 and 55 are displaced elastically by the same amount at any angle when the force being applied has the same strength. Furthermore, the elastic tubular members 35 and 55 are displaced elastically as being independent of each other.

In the first embodiment, the elastic tubular members 35 and 55 are most displaced elastically toward the angle to be shifted in the circumferential direction. The elastic tubular members 35 and 55 are most displaced elastically at the annular narrow portions 35A and 55A thereof in the direction of the axis. The annular narrow portions 35A and 55A contact the power supply terminal 21 along a circular line before the power supply terminal 21 is tilted, while the annular narrow portions 35A and 55A contact the power supply terminal 21 along an oval line as the power supply terminal 21 is tilted.

As shown in FIG. 4(B), the elastic tubular members 35 and 55 include the plurality of the slits 36 and 56 arranged in the circumferential direction thereof, respectively. Accordingly, fine strip portions 35B and 55B situated between the slits 36 and 56 are displaced elastically in the direction of the radius as a thickness direction thereof, respectively. Therefore, an elastic force (pressure) applied to the power supply terminal 21 as a reaction force is applied in the direction of the radius toward the axis line X-1 at each of the fine strip portions 35B and 55B.

In the first embodiment, when the power supply terminal 21 is tilted a size of a space between the terminal penetrating portion 14 and the power supply terminal 21 is varied at positions. Further, the power supply terminal 21 is tilted around a plane formed where the power supply terminal 21 contacts with the annular narrow portion 35A of the elastic tubular member 35 situated in the lower side. The controlling portion 32A provided in the receptacle hole 32 of the first receptacle terminal 31 controls the elastic tubular member 35 so that the elastic tubular member 35 is not displaced excessively. It is similar about the elastic tubular member 55.

Second Embodiment

Next, a second embodiment of the present invention will be explained. As shown in FIGS. 1(A), 1(B) and 6, in the first embodiment, the elastic tubular members 35, 55 are respectively provided in the first mating connector 30 and the second mating connector 50. In the present invention, the elastic tubular member 35 may be provided in the intermediate connector 10, not limited to the first embodiment.

Figure 7:
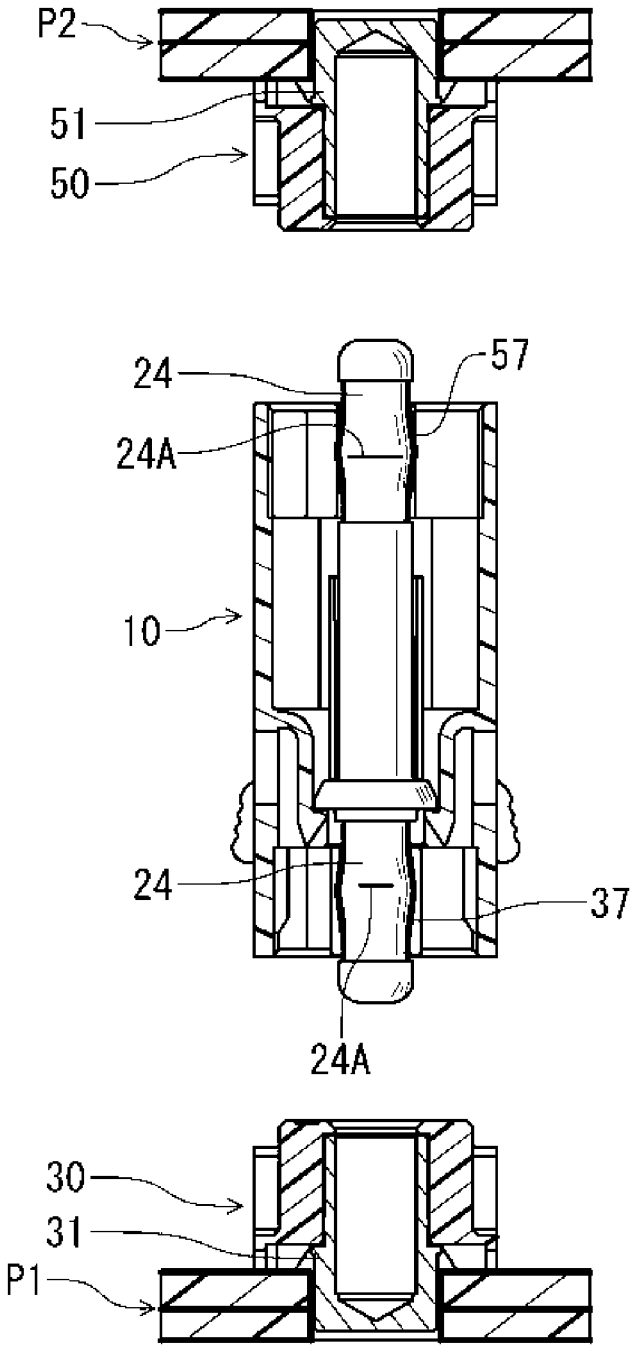
FIG. 7 is a longitudinal sectional view showing an intermediate connector, a first mating connector and the second mating connector of an electrical connector assembly in a state before being connected to each other according to a second embodiment of the present invention.
Figure 8:
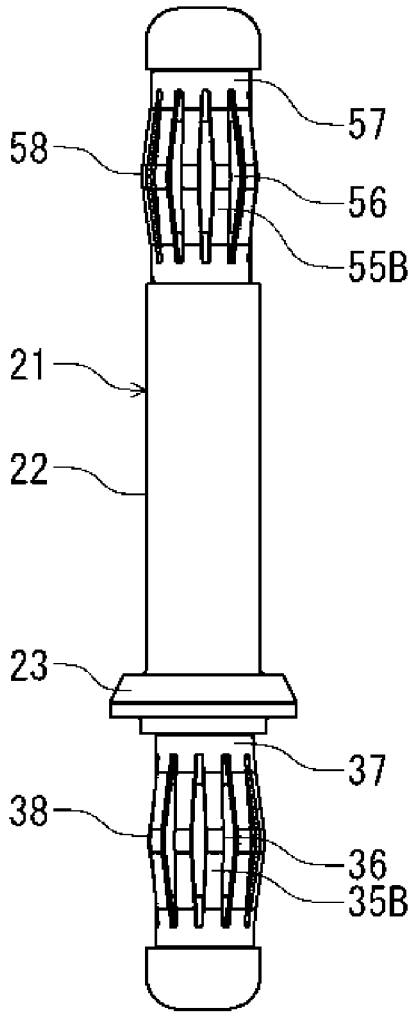
FIG. 8 is a front view showing a power supply terminal and an elastic tubular member of the electrical connector assembly according to the second embodiment of the present invention.

FIG. 7 is a longitudinal sectional view showing an intermediate connector 10, a first mating connector 30 and the second mating connector 50 of an electrical connector assembly according to the second embodiment of the present invention. FIG. 8 is a front view showing an elastic tubular member 37 and the power supply terminal 21 of the intermediate connector 10 of the electrical connector assembly according to the second embodiment of the present invention.

As shown in FIG. 7, the elastic tubular member 37 is attached to the power supply terminal 21 of the intermediate connector 10. The power supply connector 21 includes a concaved supporting surface 24 at each of both end portions thereof. The concaved supporting surface 24 is formed in a concaved shape to be narrow in order to attach the elastic tubular member 37 thereto. The concaved supporting surface 24 gradually increases a radius thereof toward a central portion in a direction of an axis thereof and provides a regulating portion 24A at a position having the largest radius thereof.

As shown in FIG. 8, the elastic tubular member 37 to be attached to the concaved supporting surface 24 is formed by rolling a metal plate including the slit 36 into a tubular shape, similar to the first embodiment shown in FIGS. 4(A) and 4(B). On the other hand, unlike the first embodiment shown in FIGS. 4(A) and 4(B), the elastic tubular member 37 has a tapered shape with a radius being the largest at a middle portion in the direction of the axis thereof. Therefore, the elastic tubular member 37 includes an annular expanding portion 38 at a position having the largest radius thereof.

In the second embodiment, the annular expanding portion 38 elastically expands the radius thereof for being attached to the concaved supporting surface 24. Then the annular expanding portion 38 is supported by the concaved supporting surface 24 with a contact pressure as an elastic force thereof in a direction of shrinking the radius for recovering. In this state, an outer radius of the annular expanding portion 38 is larger than an outer radius of the main body portion 22 of the power supply terminal 21. The main body portion 22 is situated between the both of the concaved supporting surfaces 24 in the direction of the axis.

In the second embodiment, as described above, the elastic tubular member 37 thus supported by the concaved supporting surface 24 of the power supply terminal 21 is connected to the first mating connector 30 and the second mating connector 50 as the both end portions of the power supply terminal 21 are inserted into the first receptacle terminal 31 of the first mating connector 30 and the second receptacle terminal 51 of the second mating connector 50, respectively. Further, the power supply terminal 21 is connected electrically with the first receptacle terminal 31 and the second receptacle terminal 51 as an elastic force due to an elastic displacement is generated between the first receptacle terminal 31, the second receptacle terminal 51 and the power supply terminal 21, respectively.

In the second embodiment, the elastic tubular member 37 is elastically displaced in the direction of shrinking the radius thereof. The regulating portion 24A provided in the concaved supporting surface 24 regulates the elastic tubular member 37 so that the elastic tubular member 37 is not displaced excessively. As described above, the elastic tubular member 37 is displaced elastically, enabling the power supply terminal 21, the first mating connector 30 and the second mating connector 50 to relatively move and tilt in the direction of the axis at any angle within the circumference direction around the axis of the power supply terminal 21, with a similar principle to the first embodiment shown in FIGS. 1(A), 1(B) and 6.

In the present invention, the elastic tubular member attached to each of the end portions of the power supply terminal may not have the same shape. For example, the elastic tubular member shown in FIGS. 1(A), 1(B) and 6 may be attached to one end portion of the power supply terminal and the elastic tubular member shown in FIGS. 7 and 8 may be attached to another end portion of the power supply terminal.

In the present invention, in the embodiments described above, the connector includes only the power supply terminal. The connector may include a signal terminal as well as the power supply terminal. Further, other connector including the signal terminal may be used in combination.

Furthermore, the elastic tubular member is not limited to be configured as shown in the drawings. The elastic tubular member may be any conductive members having a substantial cylindrical shape capable of elastic displacement by the same amount at any angle within a circumferential direction.

The disclosure of Japanese Patent Application No. 2011-232903 filed on Oct. 24, 2011, is incorporated in the application by reference.

While the invention has been explained with reference to the specific embodiments of the invention, the explanation is illustrative and the invention is limited only by the appended claims.

What is claimed is:

1. An electric connector assembly, comprising:

a first attaching connector to be attached to a first circuit board;

a second attaching connector to be attached to a second circuit board; and an intermediate connector disposed between the first attaching connector and the second attaching connector for connecting the first attaching connector to the second attaching connector, wherein said intermediate connector includes a power source terminal and a terminal penetrating portion, said power source terminal includes a cylindrical main body portion and a flange portion, said cylindrical main body portion is accommodated in the terminal penetrating portion with a space in between so that the cylindrical main body portion can move in the terminal penetrating portion, said flange portion is arranged to contact with an edge of the terminal penetrating portion and has a diameter greater than an inner diameter of the terminal penetrating portion, said first attaching connector includes a first receiving terminal for contacting with the power source terminal, said second attaching connector includes a second receiving terminal for contacting with the power source terminal, one of said first receiving terminal and said power source terminal and one of said second receiving terminal and said power source terminal include an elastic cylindrical member so that the power source terminal is capable of inclining and moving in a radial direction at an arbitrary angle position along a circumferential direction around an axial line of the power source terminal, and said elastic cylindrical member includes a circumferential surface contacting between the power source terminal and the first receiving terminal or the second receiving terminal in an elastically deformed state.

2. The electric connector assembly according to claim 1, wherein said elastic cylindrical member is formed of a metal plate having a cylindrical shape, said elastic cylindrical member includes a plurality of slits extending in an axial line direction along the circumferential direction and disposed between end portions of the elastic cylindrical member in the axial line direction, and said elastic cylindrical member includes a ring shape contracted portion at a middle portion thereof in the axial line direction, said ring shape contracted portion having a diameter smaller than that of the end portions of the elastic cylindrical member in the axial line direction so that the elastic cylindrical member is capable of being retained in the first receiving terminal and the second receiving terminal.

3. The electric connector assembly according to claim 2, wherein each of said first receiving terminal and said second receiving terminal includes a retaining hole for retaining the elastic cylindrical member and a regulating portion on an inner circumferential portion of the retaining hole for restricting an outer circumferential surface of the ring shape contracted portion of the elastic cylindrical member from expanding in the radial direction.

4. The electric connector assembly according to claim 1, wherein said elastic cylindrical member is formed of a metal plate having a cylindrical shape, said elastic cylindrical member includes a plurality of slits extending in an axial line direction along the circumferential direction and disposed between end portions of the elastic cylindrical member in the axial line direction, and said elastic cylindrical member includes a ring shape expanded portion at a middle portion thereof in the axial line direction, said ring shape expanded portion having a diameter greater than that of the end portions of the elastic cylindrical member in the axial line direction so that the elastic cylindrical member is capable of being attached to outer circumferential surfaces of end portions of the power source terminal.

5. The electric connector assembly according to claim 4, wherein said power source terminal includes an attaching outer circumferential surface for attaching the elastic cylindrical member and a regulating portion on the attaching outer circumferential surface for restricting an inner circumferential surface of the ring shape expanded portion of the elastic cylindrical member from contracting in the radial direction.

6. An electric connector assembly, comprising:

a first attaching connector to be attached to a first circuit board;

a second attaching connector to be attached to a second circuit board; and an intermediate connector disposed between the first attaching connector and the second attaching connector for connecting the first attaching connector to the second attaching connector, wherein said intermediate connector includes a power source terminal, said first attaching connector includes a first receiving terminal for contacting with the power source terminal, said second attaching connector includes a second receiving terminal for contacting with the power source terminal, one of said first receiving terminal and said power source terminal and one of said second receiving terminal and said power source terminal include an elastic cylindrical member so that the power source terminal is capable of inclining and moving in a radial direction at an arbitrary angle position along a circumferential direction around an axial line of the power source terminal, said elastic cylindrical member includes a circumferential surface contacting between the power source terminal and the first receiving terminal or the second receiving terminal in an elastically deformed state, said elastic cylindrical member is formed of a metal plate having a cylindrical shape, said elastic cylindrical member includes a plurality of slits extending in an axial line direction along the circumferential direction and disposed between end portions of the elastic cylindrical member in the axial line direction, and said elastic cylindrical member includes a ring shape contracted portion at a middle portion thereof in the axial line direction, said ring shape contracted portion having a diameter smaller than that of the end portions of the elastic cylindrical member in the axial line direction so that the elastic cylindrical member is capable of being retained in the first receiving terminal and the second receiving terminal.

7. The electric connector assembly according to claim 6, wherein each of said first receiving terminal and said second receiving terminal includes a retaining hole for retaining the elastic cylindrical member and a regulating portion on an inner circumferential portion of the retaining hole for restricting an outer circumferential surface of the ring shape contracted portion of the elastic cylindrical member from expanding in the radial direction.

8. The electric connector assembly according to claim 6, wherein said elastic cylindrical member is formed of a metal plate having a cylindrical shape, said elastic cylindrical member includes a plurality of slits extending in an axial line direction along the circumferential direction and disposed between end portions of the elastic cylindrical member in the axial line direction, and said elastic cylindrical member includes a ring shape expanded portion at a middle portion thereof in the axial line direction, said ring shape expanded portion having a diameter greater than that of the end portions of the elastic cylindrical member in the axial line direction so that the elastic cylindrical member is capable of being attached to outer circumferential surfaces of end portions of the power source terminal.

9. The electric connector assembly according to claim 8, wherein said power source terminal includes an attaching outer circumferential surface for attaching the elastic cylindrical member and a regulating portion on the attaching outer circumferential surface for restricting an inner circumferential surface of the ring shape expanded portion of the elastic cylindrical member from contracting in the radial direction.

* * * * *